US005273592A

United States Patent [19]

Chi Li

[11] Patent Number: 5,273,592

[45] Date of Patent: Dec. 28, 1993

[54] METHOD OF CLEANING USING PARTIALLY FLUORINATED ETHERS HAVING A TERTIARY STRUCTURE

[75] Inventor: Chien Chi Li, East Aurora, N.Y.

[73] Assignee: AllieSignal Inc., Morristown, N.J.

[21] Appl. No.: 786,473

[22] Filed: Nov. 1, 1991

[51] Int. Cl.[5] ..... C23G 5/032; B08B 7/00

[52] U.S. Cl. ..... 134/40; 134/2; 252/170; 252/364

[58] Field of Search ..... 252/171, 364, 170; 134/40, 41.3, 2, 29, 31; 514/722; 568/684

[56] References Cited

U.S. PATENT DOCUMENTS

| | | | |
|---|---|---|---|
| 2,200,354 | 5/1940 | Bishop, Jr. | 252/171 |
| 3,128,315 | 4/1964 | Hardies | 252/171 |
| 3,904,430 | 9/1975 | Tipping et al. | 134/31 |
| 4,024,192 | 5/1977 | Benninger et al. | 252/364 |
| 4,035,258 | 7/1977 | Reusser | 252/364 |
| 4,999,127 | 3/1991 | Merchant | 252/171 |
| 5,023,009 | 6/1991 | Merchant | 252/171 |
| 5,023,010 | 6/1991 | Merchant | 252/171 |
| 5,026,498 | 6/1991 | Merchant | 252/171 |

FOREIGN PATENT DOCUMENTS 61-129734 6/1986 Japan .

OTHER PUBLICATIONS

European Patent Application Abstract EP 454109 30 (Oct. 1991).

*Primary Examiner*—David Brunsman

*Attorney, Agent, or Firm*—Melanie L. Brown; Jay P. Friedenson

[57] ABSTRACT

The present invention provides a method of substantially dissolving contaminants or removing contaminants from the surface of a substrate. The method comprises the step of using a solvent of the Formula

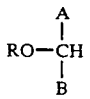

wherein R is a hydrocarbon having 1 to 3 carbon atoms and A and B are the same or different and partially fluorinated or perfluorinated alkyl groups having 1 to 2 carbon atoms.

18 Claims, No Drawings

METHOD OF CLEANING USING PARTIALLY FLUORINATED ETHERS HAVING A TERTIARY STRUCTURE

BACKGROUND OF THE INVENTION

The present invention relates to a method of cleaning using partially fluorinated ethers having a tertiary structure.

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room-temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For soils which are difficult to remove, where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al. in U.S. Pat. No. 3,085,918 disclose such suitable vapor degreasers comprising a boiling sump, a clean sump, a water separator, and other ancilliary equipment.

Cold cleaning is another application where a number of solvents are used. In most cold cleaning applications, the soiled part is either immersed in the fluid or wiped with rags or similar objects soaked in solvents.

In cold cleaning applications, the use of the aerosol packaging concept has long been found to be a convenient and cost effective means of dispensing solvents. Aerosol products utilize a propellant gas or mixture of propellant gases, preferably in a liquefied gas rather than a compressed gas state, to generate sufficient pressure to expel the active ingredients, i.e. product concentrates such as solvents, from the container upon opening of the aerosol valve. The propellants may be in direct contact with the solvent, as in most conventional aerosol systems, or may be isolated from the solvent, as in barrier-type aerosol systems.

Chlorofluorocarbon solvents, such as trichlorotrifluoroethane, have attained widespread use in recent years as effective, nontoxic, and nonflammable agents useful in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like. Trichlorotrifluoroethane has two isomers: 1,1,2-trichloro-1,2,2-trifluoroethane (known in the art as CFC-113) and 1,1,1-trichloro-2,2,2-trifluoroethane (known in the art as CFC-113a). CFC-113 has a boiling point of about 470° C. and has been found to have satisfactory solvent power for greases, oils, waxes, and the like.

Another commonly used solvent is chloroform (known in the art as HCC-20) which has a boiling point of about 630° C. Perchloroethylene is a commonly used dry cleaning and vapor degreasing solvent which has a boiling point of about 1210° C. These compounds are disadvantageous for use as solvents because they are toxic; also, chloroform causes liver damage when inhaled in excess.

Although chlorine is known to contribute to the solvency capability of a compound, fully halogenated chlorofluorocarbons are suspected of causing environmental problems in connection with the earth's protective ozone layer. Thus, the art is seeking new compounds which do not contribute to environmental problems but yet provide the solvency properties of CFC-113.

Azeotropic compositions having non-tertiary partially halogenated ethers therein are known in the art. For example, U.S. Pat. No. 4,999,127 teaches azeotropic compositions of 2-chloro-1,1,2-trifluoroethyl-2-difluoromethyl ether, trans-1,2dichloroethylene, and methanol which are useful as solvents. U.S. Pat. No. 5,023,009 teaches azeotropic compositions of 1,1,1,2,3,3-hexafluoro-3-methoxypropane and 2,2,3,3,3-pentafluoropropanol-1. U.S. Pat. No. 5,023,010 teaches azeotropic compositions of 1,1,1,2,3,3-hexafluoro-3-methoxypropane and methanol, isopropanol, or n-propanol. U.S. Pat. No. 5,026,498 teaches azeotropic compositions of 1,1,1,2,3,3-hexafluoro-3-methoxypropane and trans-1,2dichloroethylene, cis-1,2-dichloroethylene, 1,1-dichloro-1,2-difluoroethane, or 1,2-dichloro-1,2difluoroethane.

It would be advantageous to have solvents with improved solvency characteristics compared with 1,1,1,2,3,3-hexafluoro-3-methoxypropane.

A wide variety of consumer parts is produced on an annual basis in the United States and abroad. Many of these parts have to be cleaned during various manufacturing stages in order to remove undesirable contaminants. These parts are produced in large quantities and as a result, substantial quantities of solvents are used to clean them.

Thus, solvents with improved solvency characteristics and which are negligible contributors to ozone depletion and to greenhouse warming are needed in the art.

SUMMARY OF THE INVENTION

Thus, the present invention provides a method of substantially dissolving contaminants or removing contaminants from the surface of a substrate. The method comprises the step of using a solvent of the Formula

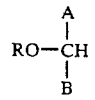

wherein R is a hydrocarbon having 1 to 3 carbon atoms, and preferably, 1 to 2 carbon atoms and A and B are the same or different and partially fluorinated or perfluorinated alkyl groups having 1 to 2 carbon atoms. R may be any group having only hydrogen and carbon atoms therein including alkyl and alkenyl. Preferably, A and B have sufficient fluorine atoms so that the solvent is nonflammable.

Because C in the formula above has an oxygen and two carbons thereon, these solvents have a tertiary structure. This tertiary structure provides good solvency power. The solvents have boiling points in the range of about 40° to about 1200° C. and have zero ozone depletion potentials.

Other advantages of the present invention will become apparent from the following description.

DETAILED DESCRIPTION OF THE PREFERRED EMBODIMENTS

Examples of the solvents of the present invention are listed in the Table below.

| FORMULA | NAME |
|---|---|
| $CH_3OC(CF_3)_2H$ | 2-methoxy-1,1,1,3,3,3-hexafluoropropane |
| $CH_3OC(CF_3)(CF_2H)H$ | 2-methoxy-1,1,1,3,3-pentafluoropropane |
| $CH_3OC(CF_3)(CFH_2)H$ | 2-methoxy-1,1,1.3-tetrafluoropropane |
| $CH_3OC(CF_2H)_2H$ | 2-methoxy-1,1,3,3-tetrafluoropropane |
| $CH_3OC(CF_2H)(CFH_2)H$ | 2-methoxy-1,1,3-trifluoropropane |
| $CH_3OC(CFH_2)_2H$ | 2-methoxy-1,3-difluoropropane |
| $CH_3CH_2OC(CF_3)_2H$ | 2-ethoxy-1,1,1.3,3,3-hexafluoropropane |
| $CH_3CH_2OC(CF_3)(CF_2H)H$ | 2-ethoxy-1,1,1,3,3-pentafluoropropane |
| $CH_3CH_2OC(CF_3)(CFH_2)H$ | 2-ethoxy-1,1,1,3-tetrafluoropropane |
| $CH_3CH_2OC(CF_2H)_2H$ | 2-ethoxy-1,1,3,3-tetrafluoropropane |
| $CH_3CH_2OC(CF_2H)(CFH_2)H$ | 2-ethoxy-1,1,3-trifluoropropane |
| $CH_3CH_2OC(CFH_2)_2H$ | 2-ethoxy-1,3-difluoropropane |
| $CH_3(CH_2)_2OC(CF_3)_2H$ | 2-propoxy-1,1.1,3,3,3-hexafluoropropane |
| $CH_3(CH_2)_2OC(CF_3)(CF_2H)H$ | 2-propoxy-1,1,1.3,3-pentafluoropropane |
| $CH_3(CH_2)_2OC(CF_3)(CFH_2)H$ | 2-propoxy-1,1,1,3-tetrafluoropropane |
| $CH_3(CH_2)_2OC(CF_2H)_2H$ | 2-propoxy-1.1,3,3-tetrafluoropropane |
| $CH_3(CH_2)_2OC(CF_2H)(CFH_2)H$ | 2-propoxy-1,1,3-trifluoropropane |
| $CH_3(CH_2)_2OC(CFH_2)_2H$ | 2-propoxy-1,3-difluoropropane |
| $(CH_3)_2CHOC(CF_3)_2H$ | 2-isopropoxy-1,1,1,3,3,3-hexafluoropropane |
| $(CH_3)_2CHOC(CF_3)(CF_2H)H$ | 2-isopropoxy-1,1,1,3,3-pentafluoropropane |
| $(CH_3)_2CHOC(CF_3)(CFH_2)H$ | 2-isopropoxy-1,1,1.3-tetrafluoropropane |
| $(CH_3)_2CHOC(CF_2H)_2H$ | 2-isopropoxy-1,1,3,3-tetrafluoropropane |
| $(CH_3)_2CHOC(CF_2H)(CFH_2)H$ | 2-isopropoxy-1,1,3-trifluoropropane |
| $(CH_3)_2CHOC(CFH_2)_2H$ | 2-isopropoxy-1.3-difluoropropane |
| $CH_3OC(CF_3)(CF_2CF_3)H$ | 2-methoxy-1,1.1,3,3.4,4,4-octafluorobutane |
| $CH_3OC(CF_3)(CF_2CF_2H)H$ | 2-methoxy-1,1,1.3,3,4.4-heptafluorobutane |
| $CH_3OC(CF_3)(CFHCF_3)H$ | 2-methoxy-1.1.1,3.4,4,4-heptafluorobutane |
| $CH_3OC(CF_3)(CF_2CFH_2)H$ | 2-methoxy-1,1,1,3,3,4-hexafluorobutane |
| $CH_3OC(CF_3)(CFHCF_2H)H$ | 2-methoxy-1,1,1,3,4.4-hexafluorobutane |
| $CH_3OC(CF_3)(CH_2CF_3)H$ | 2-methoxy-1,1,1,4,4,4-hexafluorobutane |
| $CH_3OC(CF_3)(CF_2CH_3)H$ | 2-methoxy-1,1,1,3,3,3-hexafluorobutane |
| $CH_3OC(CF_3)(CFHCFH_2)H$ | 2-methoxy-1,1,1,3,4-pentafluorobutane |
| $CH_3OC(CF_3)(CH_2CF_2H)H$ | 2-methoxy-1,1,1,4,4-pentafluorobutane |
| $CH_3OC(CF_3)(CH_2CFH_2)H$ | 2-methoxy-1,1,1,4-tetrafluorobutane |
| $CH_3OC(CF_3)(CFHCH_3)H$ | 2-methoxy-1,1,1,3-tetrafluorobutane |
| $CH_3OC(CF_2H)(CF_2CF_3)H$ | 2-methoxy-1,1,3,3,4,4,4-heptafluorobutane |
| $CH_3OC(CF_2H)(CF_2CF_2H)H$ | 2-methoxy-1,1,3,3,4,4-hexafluorobutane |
| $CH_3OC(CF_2H)(CFHCF_3)H$ | 2-methoxy-1,1,3,4,4,4-hexafluorobutane |
| $CH_3OC(CF_2H)(CF_2CFH_2)H$ | 2-methoxy-1,1,3,3,4-pentafluorobutane |
| $CH_3OC(CF_2H)(CFHCF_2H)H$ | 2-methoxy-1,1,3,4,4-pentafluorobutane |
| $CH_3OC(CF_2H)(CH_2CF_3)H$ | 2-methoxy-1,1,4,4,4-pentafluorobutane |
| $CH_3OC(CF_2H)(CF_2CH_3)H$ | 2-methoxy-1,1,3,3-tetrafluorobutane |
| $CH_3OC(CF_2H)(CFHCFH_2)H$ | 2-methoxy-1,1,3,4-tetrafluorobutane |
| $CH_3OC(CF_2H)(CH_2CF_2H)H$ | 2-methoxy-1,1,4,4-tetrafluorobutane |
| $CH_3OC(CF_2H)(CH_2CFH_2)H$ | 2-methoxy-1,1,4-trifluorobutane |
| $CH_3OC(CF_2H)(CFHCH_3)H$ | 2-methoxy-1,1,3-trifluorobutane |
| $CH_3OC(CFH_2)(CF_2CF_3)H$ | 2-methoxy-1,3,3,4,4,4-hexafluorobutane |
| $CH_3OC(CFH_2)(CF_2CF_2H)H$ | 2-methoxy-1,3,3,4,4-pentafluorobutane |
| $CH_3OC(CFH_2)(CFHCF_3)H$ | 2-methoxy-1,3,4,4,4-pentafluorobutane |
| $CH_3OC(CFH_2)(CF_2CFH_2)H$ | 2-methoxy-1,3,3,4-tetrafluorobutane |
| $CH_3OC(CFH_2)(CFHCF_2H)H$ | 2-methoxy-1,3,4,4-tetrafluorobutane |
| $CH_3OC(CFH_2)(CH_2CF_3)H$ | 2-methoxy-1,4,4,4-tetrafluorobutane |
| $CH_3OC(CFH_2)(CF_2CH_3)H$ | 2-methoxy-1,3,3-trifluorobutane |
| $CH_3OC(CFH_2)(CFHCFH_2)H$ | 2-methoxy-1,3,4-trifluorobutane |
| $CH_3OC(CFH_2)(CH_2CF_2H)H$ | 2-methoxy-1,4,4-trifluorobutane |
| $CH_3OC(CFH_2)(CH_2CFH_2)H$ | 2-methoxy-1,4-difluorobutane |
| $CH_3OC(CFH_2)(CFHCH_3)H$ | 2-methoxy-1,3-difluorobutane |
| $CH_3OC(CF_2CF_3)_2H$ | 3-methoxy-1,1,1,2,2,4,4,5,5,5-decafluoropentane |
| $CH_3OC(CF_2CF_3)(CF_2CF_2H)H$ | 3-methoxy-1,1,1,2,2,4,4,5,5-nonafluoropentane |
| $CH_3OC(CF_2CF_3)(CFHCF_3)H$ | 3-methoxy-1,1,1,2,2,4,5,5,5-nonafluoropentane |
| $CH_3OC(CF_2CF_3)(CF_2CFH_2)H$ | 3-methoxy-1,1,1,2,2,4,4,5-octafluoropentane |
| $CH_3OC(CF_2CF_3)(CFHCF_2H)H$ | 3-methoxy-1,1,1,2,2,4,5,5-octafluoropentane |
| $CH_3OC(CF_2CF_3)(CH_2CF_3)H$ | 3-methoxy-1,1,1,2,2,5,5,5-octafluoropentane |
| $CH_3OC(CF_2CF_3)(CF_2CH_3)H$ | 3-methoxy-1,1,1,2,2,4,4-heptafluoropentane |
| $CH_3OC(CF_2CF_3)(CFHCFH_2)H$ | 3-methoxy-1,1,1,2,2,4,5-heptafluoropentane |
| $CH_3OC(CF_2CF_3)(CH_2CF_2H)H$ | 3-methoxy-1,1,1,2,2,5,5-heptafluoropentane |
| $CH_3OC(CF_2CF_3)(CH_2CFH_2)H$ | 3-methoxy-1,1,1,2,2,5-hexafluoropentane |
| $CH_3OC(CF_2CF_3)(CFHCH_3)H$ | 3-methoxy-1,1,1,2,2,3- |

-continued

| FORMULA | NAME |
|---|---|
| | hexafluoropentane |
| $CH_3OC(CF_2CF_2H)_2H$ | 3-methoxy-1,1,2,2,4,4,5,5-octafluoropentane |
| $CH_3OC(CF_2CF_2H)(CFHCF_3)H$ | 3-methoxy-1,1,1,2,4,4,5,5-octafluoropentane |
| $CH_3OC(CF_2CF_2H)(CF_2CFH_2)H$ | 3-methoxy-1,1,2,2,3,3,4-heptafluoropentane |
| $CH_3OC(CF_2CF_2H)(CFHCF_2H)H$ | 3-methoxy-1,1,2,2,4,5,5-heptafluoropentane |
| $CH_3OC(CF_2CF_2H)(CH_2CF_3)H$ | 3-methoxy-1,1,1,4,4,5,5-heptafluoropentane |
| $CH_3OC(CF_2CF_2H)(CF_2CH_3)H$ | 3-methoxy-1,1,2,2,4,4-hexafluoropentane |
| $CH_3OC(CF_2CF_2H)(CFHCFH_2)H$ | 3-methoxy-1,1,2,2,4,5-hexafluoropentane |
| $CH_3OC(CF_2CF_2H)(CH_2CF_2H)H$ | 3-methoxy-1,1,2,2,4,4-hexafluoropentane |
| $CH_3OC(CF_2CF_2H)(CH_2CFH_2)H$ | 3-methoxy-1,1,2,2,5-pentafluoropentane |
| $CH_3OC(CF_2CF_2H)(CFHCH_3)H$ | 3-methoxy-1,1,2,2,4-pentafluoropentane |
| $CH_3OC(CFHCF_3)_2H$ | 3-methoxy-1,1,1,2,4,5,5,5-octafluoropentane |
| $CH_3OC(CFHCF_3)(CF_2CFH_2)H$ | 3-methoxy-1,1,1,2,4,4,5-heptafluoropentane |
| $CH_3OC(CFHCF_3)(CFHCF_2H)H$ | 3-methoxy-1,1,1,2,4,5,5-heptafluoropentane |
| $CH_3OC(CFHCF_3)(CH_2CF_3)H$ | 3-methoxy-1,1,1,2,5,5,5-heptafluoropentane |
| $CH_3OC(CFHCF_3)(CF_2CH_3)H$ | 3-methoxy-1,1,1,2,4,4-hexafluoropentane |
| $CH_3OC(CFHCF_3(CFHCFH_2)H$ | 3-methoxy-1,1,1,2,4,5-hexafluoropentane |
| $CH_3OC(CFHCF_3)(CH_2CF_2H)H$ | 3-methoxy-1,1,1,2,5,5-hexafluoropentane |
| $CH_3OC(CFHCF_3)(CH_2CFH_2)H$ | 3-methoxy-1,1,1,2,5-pentafluoropentane |
| $CH_3OC(CFHCF_3)(CFHCH_3)H$ | 3-methoxy-1,1,1,2,4-pentafluoropentane |
| $CH_3OC(CF_2CFH_2)_2H$ | 3-methoxy-1,2,2,4,4,5-hexafluoropentane |
| $CH_3OC(CF_2CFH_2)(CFHCF_2H)H$ | 3-methoxy-1,2,2,3,4,4-hexafluoropentane |
| $CH_3OC(CF_2CFH_2)(CH_2CF_3)H$ | 3-methoxy-1,2,2,5,5,5-hexafluoropentane |
| $CH_3OC(CF_2CFH_2)(CF_2CH_3)H$ | 3-methoxy-1,2,2,4,4-pentafluoropentane |
| $CH_3OC(CF_2CFH_2)(CFHCFH_2)H$ | 3-methoxy-1,2,2,4,5-pentafluoropentane |
| $CH_3OC(CF_2CFH_2)(CH_2CF_2H)H$ | 3-methoxy-1,2,2,5,5-pentafluoropentane |
| $CH_3OC(CF_2CFH_2)(CH_2CFH_2)H$ | 3-methoxy-1,2,2,5-tetrafluoropentane |
| $CH_3OC(CF_2CFH_2)(CFHCH_3)H$ | 3-methoxy-1,2,2,4-tetrafluoropentane |
| $CH_3OC(CFHCF_2H)_2H$ | 3-methoxy-1,1,2,4,5,5-hexafluoropentane |
| $CH_3OC(CFHCF_2H)(CH_2CF_3)H$ | 3-methoxy-1,1,2,5,5,5-hexafluoropentane |
| $CH_3OC(CFHCF_2H)(CF_2CH_3)H$ | 3-methoxy-1,1,2,4,4-pentafluoropentane |
| $CH_3OC(CFHCF_2H)(CFHCFH_2)H$ | 3-methoxy-1,1,2,4,5-pentafluoropentane |
| $CH_3OC(CFHCF_2H)(CH_2CF_2H)H$ | 3-methoxy-1,1,2,5,5-pentafluoropentane |
| $CH_3OC(CFHCF_2H)(CH_2CFH_2)H$ | 3-methoxy-1,1,2,5,5-pentafluoropentane |
| $CH_3OC(CFHCF_2H)(CFHCH_3)H$ | 3-methoxy-1,1,2,4-tetrafluoropentane |
| $CH_3OC(CH_2CF_3)_2H$ | 3-methoxy-1,1,1,5,5,5-hexafluoropentane |
| $CH_3OC(CH_2CF_3)(CF_2CH_3)H$ | 3-methoxy-1,1,1,4,4-pentafluoropentane |
| $CH_3OC(CH_2CF_3)(CFHCFH_2)H$ | 3-methoxy-1,1,1,4,5-pentafluoropentane |
| $CH_3OC(CH_2CF_3)(CH_2CF_2H)H$ | 3-methoxy-1,1,1,5,5-pentafluoropentane |
| $CH_3OC(CH_2CF_3)(CH_2CFH_2)H$ | 3-methoxy-1,1,1,5-tetrafluoropentane |
| $CH_3OC(CH_2CF_3)(CFHCH_3)H$ | 3-methoxy-1,1,1,3-tetrafluoropentane |

-continued

| FORMULA | NAME |
|---|---|
| $CH_3OC(CF_2CH_3)_2H$ | 3-methoxy-2,2,4,4-tetrafluoropentane |
| $CH_3OC(CF_2CH_3)(CFHCFH_2)H$ | 3-methoxy-2,2,3,4-tetrafluoropentane |
| $CH_3OC(CF_2CH_3)(CH_2CF_2H)H$ | 3-methoxy-2,2,5,5-tetrafluoropentane |
| $CH_3OC(CF_2CH_3)(CH_2CFH_2)H$ | 3-methoxy-2,2,5-trifluoropentane |
| $CH_3OC(CF_2CH_3)(CFHCH_3)H$ | 3-methoxy-2,2,4-trifluoropentane |
| $CH_3OC(CFHCFH_2)_2H$ | 3-methoxy-1,2,4,5-tetrafluoropentane |
| $CH_3OC(CFHCFH_2)(CH_2CF_2H)H$ | 3-methoxy-1,2,5,5-tetrafluoropentane |
| $CH_3OC(CFHCFH_2)(CH_2CFH_2)H$ | 3-methoxy-1,2,5-trifluoropentane |
| $CH_3OC(CFHCFH_2)(CFHCH_3)H$ | 3-methoxy-1,2,4-trifluoropentane |
| $CH_3OC(CH_2CF_2H)_2H$ | 3-methoxy-1,1,5,5-tetrafluoropentane |
| $CH_3OC(CH_2CF_2H)(CH_2CFH_2)H$ | 3-methoxy-1,1,5-trifluoropentane |
| $CH_3OC(CH_2CF_2H)(CFHCH_3)H$ | 3-methoxy-1,1,4-trifluoropentane |
| $CH_3OC(CH_2CF_2)_2H$ | 3-methoxy-1,5-difluoropentane |
| $CH_3OC(CFHCH_3)_2H$ | 3-methoxy-2,4-difluoropentane |
| $CH_3CH_2OC(CF_3)(CF_2CF_3)H$ | 2-ethoxy-1,1,1,3,3,4,4,4-octafluorobutane |
| $CH_3CH_2OC(CF_3)(CF_2CF_2H)H$ | 2-ethoxy-1,1,1,3,3,4,4-heptafluorobutane |
| $CH_3CH_2OC(CF_3)(CFHCF_3)H$ | 2-ethoxy-1,1,1,3,4,4,4-heptafluorobutane |
| $CH_3CH_2OC(CF_3)(CF_2CFH_2)H$ | 2-ethoxy-1,1,1,3,3,4-hexafluorobutane |
| $CH_3CH_2OC(CF_3)(CFHCF_2H)H$ | 2-ethoxy-1,1,1,3,4,4-hexafluorobutane |
| $CH_3CH_2OC(CF_3)(CH_2CF_3)H$ | 2-ethoxy-1,1,1,4,4,4-hexafluorobutane |
| $CH_3CH_2OC(CF_3)(CF_2CH_3)H$ | 2-ethoxy-1,1,1,3,3-pentafluorobutane |
| $CH_3CH_2OC(CF_3)(CFHCFH_2)H$ | 2-ethoxy-1,1,1,3,4-pentafluorobutane |
| $CH_3CH_2OC(CF_3)(CH_2CF_2H)H$ | 2-ethoxy-1,1,1,4,4-pentafluorobutane |
| $CH_3CH_2OC(CF_3)(CH_2CFH_2)H$ | 2-ethoxy-1,1,1,4-tetrafluorobutane |
| $CH_3CH_2OC(CF_3)(CFHCH_3)H$ | 2-ethoxy-1,1,1,3-tetrafluorobutane |
| $CH_3CH_2OC(CF_2H)(CF_2CF_3)H$ | 2-ethoxy-1,1,3,3,4,4,4-heptafluorobutane |
| $CH_3CH_2OC(CF_2H)(CF_2CF_2H)H$ | 2-ethoxy-1,1,3,3,4,4-hexafluorobutane |
| $CH_3CH_2OC(CF_2H)(CFHCF_3)H$ | 2-ethoxy-1,1,3,4,4,4-hexafluorobutane |
| $CH_3CH_2OC(CF_2H)(CF_2CFH_2)H$ | 2-ethoxy-1,1,3,3,4-pentafluorobutane |
| $CH_3CH_2OC(CF_2H)(CFHCF_2H)H$ | 2-ethoxy-1,1,3,4,4-pentafluorobutane |
| $CH_3CH_2OC(CF_2H)(CH_2CF_3)H$ | 2-ethoxy-1,1,4,4,4-pentafluorobutane |
| $CH_3CH_2OC(CF_2H)(CF_2CH_3)H$ | 2-ethoxy-1,1,3,3-tetrafluorobutane |
| $CH_3CH_2OC(CF_2H)(CFHCFH_2)H$ | 2-ethoxy-1,1,3,4-tetrafluorobutane |
| $CH_3CH_2OC(CF_2H)(CH_2CF_2H)H$ | 2-ethoxy-1,1,4-tetrafluorobutane |
| $CH_3CH_2OC(CF_2H)(CH_2CFH_2)H$ | 2-ethoxy-1,1,4-trifluorobutane |
| $CH_3CH_2OC(CF_2H)(CFHCH_3)H$ | 2-ethoxy-1,1,3-trifluorobutane |
| $CH_3CH_2OC(CFH_2)(CF_2CF_3)H$ | 2-ethoxy-1,3,3,4,4,4-hexafluorobutane |
| $CH_3CH_2OC(CFH_2)(CF_2CF_2H)H$ | 2-ethoxy-1,3,3,4,4-pentafluorobutane |
| $CH_3CH_2OC(CFH_2)(CFHCF_3)H$ | 2-ethoxy-1,3,4,4,4-pentafluorobutane |
| $CH_3CH_2OC(CFH_2)(CF_2CFH_2)H$ | 2-ethoxy-1,3,3,4-tetrafluorobutane |
| $CH_3CH_2OC(CFH_2)(CFHCF_2H)H$ | 2-ethoxy-1,3,4,4- |

-continued

| FORMULA | NAME |
|---|---|
| | tetrafluorobutane |
| $CH_3CH_2OC(CFH_2)(CH_2CF_3)H$ | 2-ethoxy-1,4,4,4-tetrafluorobutane |
| $CH_3CH_2OC(CFH_2)(CF_2CH_3)H$ | 2-ethoxy-1,3,3-trifluorobutane |
| $CH_3CH_2OC(CFH_2)(CFHCFH_2)H$ | 2-ethoxy-1,3,4-trifluorobutane |
| $CH_3CH_2OC(CFH_2)(CH_2CF_2H)H$ | 2-ethoxy-1,4,4-trifluorobutane |
| $CH_3CH_2OC(CFH_2)(CH_2CFH_2)H$ | 2-ethoxy-1,4-difluorobutane |
| $CH_3CH_2OC(CFH_2)(CFHCH_3)H$ | 2-ethoxy-1,3-difluorobutane |
| $CH_3CH_2OC(CF_2CF_3)_2H$ | 3-ethoxy-1,1,1,2,2,4,4,5,5,5-decafluoropentane |
| $CH_3CH_2OC(CF_3CF_2)(CF_2CF_2H)H$ | 3-ethoxy-1,1,1,2,2,4,4,5,5-nonafluoropentane |
| $CH_3CH_2OC(CF_3CF_2)(CFHCF_3)H$ | 3-ethoxy-1,1,1,2,2,4,5,5,5-nonafluoropentane |
| $CH_3CH_2OC(CF_3CF_2)(CF_2CFH_2)H$ | 3-ethoxy-1,1,1,2,2,4,4,5-octafluoropentane |
| $CH_3CH_2OC(CF_3CF_2)(CFHCF_2H)H$ | 3-ethoxy-1,1,1,2,2,4,5,5-octafluoropentane |
| $CH_3CH_2OC(CF_3CF_2)(CH_2CF_3)H$ | 3-ethoxy-1,1,1,2,2,5,5,5-octafluoropentane |
| $CH_3CH_2OC(CF_3CF_2)(CF_2CH_3)H$ | 3-ethoxy-1,1,1,2,2,4,4-heptafluoropentane |
| $CH_3CH_2OC(CF_3CF_2)(CFHCFH_2)H$ | 3-ethoxy-111,1,1,2,2,4,5-heptafluoropentane |
| $CH_3CH_2OC(CF_3CF_2)(CH_2CF_2H)H$ | 3-ethoxy-1,1,1,2,2,5,5-heptafluoropentane |
| $CH_3CH_2OC(CF_3CF_2)(CH_2CFH_2)H$ | 3-ethoxy-1,1,1,2,2,5-hexafluoropentane |
| $CH_3CH_2OC(CF_3CF_2)(CFHCH_3)H$ | 3-ethoxy-1,1,1,2,2,4-hexafluoropentane |
| $CH_3CH_2OC(CF_2CF_2H)_2H$ | 3-ethoxy-1,1,2,2,4,4,5,5-octafluoropentane |
| $CH_3CH_2OC(CF_2CF_2H)(CFHCF_3)H$ | 3-ethoxy-1,1,2,2,4,5,5,5-octafluoropentane |
| $CH_3CH_2OC(CF_2CF_2H)(CF_2CFH_2)H$ | 3-ethoxy-1,1,2,2,4,4,5-heptafluoropentane |
| $CH_3CH_2OC(CF_2CF_2H)(CFHCF_2H)H$ | 3-ethoxy-1,1,2,2,4,5,5-heptafluoropentane |
| $CH_3CH_2OC(CF_2CF_2H)(CH_2CF_3)H$ | 3-ethoxy-1,1,2,2,5,5,5-heptafluoropentane |
| $CH_3CH_2OC(CF_2CF_2H)(CF_2CH_3)H$ | 3-ethoxy-1,1,2,2,4,4-hexafluoropentane |
| $CH_3CH_2OC(CF_2CF_2H)(CFHCFH_2)H$ | 3-ethoxy-1,1,2,2,4,5-hexafluoropentane |
| $CH_3CH_2OC(CF_2CF_2H)(CH_2CF_2H)H$ | 3-ethoxy-1,1,2,2,5,5-hexafluoropentane |
| $CH_3CH_2OC(CF_2CF_2H)(CH_2CFH_2)H$ | 3-ethoxy-1,1,2,2,5-pentafluoropentane |
| $CH_3CH_2OC(CF_2CF_2H)(CFHCH_3)H$ | 3-ethoxy-1,1,2,2,4-pentafluoropentane |
| $CH_3CH_2OC(CFHCF_3)_2H$ | 3-ethoxy-1,1,1,2,4,5,5,5-octafluoropentane |
| $CH_3CH_2OC(CFHCF_3)(CF_2CFH_2)H$ | 3-ethoxy-1,1,1,2,4,4,5-heptafluoropentane |
| $CH_3CH_2OC(CFHCF_3)(CFHCF_2H)H$ | 3-ethoxy-1,1,1,2,4,5,5-heptafluoropentane |
| $CH_3CH_2OC(CFHCF_3)(CH_2CF_3)H$ | 3-ethoxy-1,1,1,2,5,5,5-heptafluoropentane |
| $CH_3CH_2OC(CFHCF_3)(CF_2CH_3)H$ | 3-ethoxy-1,1,1,2,4,4-hexafluoropentane |
| $CH_3CH_2OC(CFHCF_3)(CFHCFH_2)H$ | 3-ethoxy-1,1,1,2,4,5-hexafluoropentane |
| $CH_3CH_2OC(CFHCF_3)(CH_2CF_2H)H$ | 3-ethoxy-1,1,1,2,5,5-hexafluoropentane |
| $CH_3CH_2OC(CFHCF_3)(CH_2CFH_2)H$ | 3-ethoxy-1,1,1,2,5-pentafluoropentane |
| $CH_3CH_2OC(CFHCF_3)(CFHCH_3)H$ | 3-ethoxy-1,1,1,2,4-pentafluoropentane |
| $CH_3CH_2OC(CF_2CFH_2)_2H$ | 3-ethoxy-1,2,2,2,4,4,5-hexafluoropentane |
| $CH_3CH_2OC(CF_2CFH_2)(CFHCF_2H)H$ | 3-ethoxy-1,2,2,4,5,5-hexafluoropentane |
| $CH_3CH_2OC(CF_2CFH_2)(CH_2CF_3)H$ | 3-ethoxy-1,2,2,5,5,5-hexafluoropentane |
| $CH_3CH_2OC(CF_2CFH_2)(CF_2CH_3)H$ | 3-ethoxy-1,2,2,4,4-pentafluoropentane |
| $CH_3CH_2OC(CF_2CFH_2)(CFHCFH_2)H$ | 3-ethoxy-1,2,2,4,5-pentafluoropentane |
| $CH_3CH_2OC(CF_2CFH_2)(CH_2CF_2H)H$ | 3-ethoxy-1,2,2,5,5-pentafluoropentane |
| $CH_3CH_2OC(CF_2CFH_2)(CH_2CFH_2)H$ | 3-ethoxy-1,2,2,5-tetrafluoropentane |
| $CH_3CH_2OC(CF_2CFH_2)(CFHCH_3)H$ | 3-ethoxy-1,2,2,4-tetrafluoropentane |
| $CH_3CH_2OC(CFHCF_2H)_2H$ | 3-ethoxy-1,1,2,4,5,5-hexafluoropentane |
| $CH_3CH_2OC(CFHCF_2H)(CH_2CF_3)H$ | 3-ethoxy-1,1,2,5,5,5-hexafluoropentane |
| $CH_3CH_2OC(CFHCF_2H)(CF_2CH_3)H$ | 3-ethoxy-1,1,2,4,4-pentafluoropentane |
| $CH_3CH_2OC(CFHCF_2H)(CFHCFH_2)H$ | 3-ethoxy-1,1,2,4,5-pentafluoropentane |
| $CH_3CH_2OC(CFHCF_2H)(CH_2CF_2H)H$ | 3-ethoxy-1,1,2,5,5-pentafluoropentane |
| $CH_3CH_2OC(CFHCF_2H)(CH_2CFH_2)H$ | 3-ethoxy-1,1,2,5-tetrafluoropentane |
| $CH_3CH_2OC(CFHCF_2H)(CFHCH_3)H$ | 3-ethoxy-1,1,2,4-tetrafluoropentane |
| $CH_3CH_2OC(CH_2CF_3)_2H$ | 3-ethoxy-1,1,1,5,5,5-hexafluoropentane |
| $CH_3CH_2OC(CH_2CF_3)(CF_2CH_3)H$ | 3-ethoxy-1,1,1,4,4-pentafluoropentane |
| $CH_3CH_2OC(CH_2CF_3)(CFHCFH_2)H$ | 3-ethoxy-1,1.1,4,5-pentafluoropentane |
| $CH_3CH_2OC(CH_2CF_3)(CH_2CF_2H)H$ | 3-ethoxy-1,1,1,5,5-pentafluoropentane |
| $CH_3CH_2OC(CH_2CF_3)(CH_2CFH_2)H$ | 3-ethoxy-1,1,1,5-tetrafluoropentane |
| $CH_3CH_2OC(CH_2CF_3)(CFHCH_3)H$ | 3-ethoxy-1,1,1,4-tetrafluoropentane |
| $CH_3CH_2OC(CF_2CH_3)_2H$ | 3-ethoxy-2,2,4,4-tetrafluoropentane |
| $CH_3CH_2OC(CH_2CF_3)(CFHCFH_2)H$ | 3-ethoxy-2,2,4,5-tetrafluoropentane |
| $CH_3CH_2OC(CF_2CH_3)_2H$ | 3-ethoxy-2,2,4,4-tetrafluoropentane |
| $CH_3CH_2OC(CF_2CH_3)(CFHCFH_2)H$ | 3-ethoxy-2,2,4,5-tetrafluoropentane |
| $CH_3CH_2OC(CF_2CH_3)(CH_2CF_2H)H$ | 3-ethoxy-2,2,5,5-tetrafluoropentane |
| $CH_3CH_2OC(CF_2CH_3)(CH_2CFH_2)H$ | 3-ethoxy-2,2,5-trifluoropentane |
| $CH_3CH_2OC(CF_2CH_3)(CFHCH_3)H$ | 3-ethoxy-2,2,4-trifluoropentane |
| $CH_3CH_2OC(CFHCFH_2)_2H$ | 3-ethoxy-1,2,4,5-tetrafluoropentane |
| $CH_3CH_2OC(CFHCFH_2)(CH_2CF_2H)H$ | 3-ethoxy-1,2.5,5-tetrafluoropentane |
| $CH_3CH_2OC(CFHCFH_2)(CH_2CFH_2)H$ | 3-ethoxy-1,2,5-trifluoropentane |
| $CH_3CH_2OC(CFHCFH_2)(CFHCH_3)H$ | 3-ethoxy-1,2,4-trifluoropentane |
| $CH_3CH_2OC(CH_2CF_2H)_2H$ | 3-ethoxy-1,1,5,5-tetrafluoropentane |
| $CH_3CH_2OC(CH_2CF_2H)(CH_2CFH_2)H$ | 3-ethoxy-1,1,5-trifluoropentane |
| $CH_3CH_2OC(CH_2CF_2H)(CFHCH_3)H$ | 3-ethoxy-1,1,4-trifluoropentane |
| $CH_3CH_2OC(CH_2CFH_2)_2H$ | 3-ethoxy-1,5-difluoropentane |
| $CH_3CH_2OC(CH_2CFH_2)(CFHCH_3)H$ | 3-ethoxy-1,4-difluoropentane |
| $CH_3CH_2OC(CFHCH_3)_2H$ | 3-ethoxy-2,4-difluoropentane |
| $CH_2{=}CHOC(CF_3)_2H$ | 2-ethenoxy-1,1,1,3,3,3-hexafluoropropane |
| $CH_2{=}CHOC(CF_3)(CF_2H)H$ | 2-ethenoxy-1,1,1,3,3-pentafluoropropane |
| $CH_2{=}CHOC(CF_3)(CFH_2)H$ | 2-ethenoxy-1,1,1,3-tetrafluoropropane |
| $CH_2{=}CHOC(CF_2H)_2H$ | 2-ethenoxy-1,1,3,3-tetrafluoropropane |
| $CH_2{=}CHOC(CF_2H)(CFH_2)H$ | 2-ethenoxy-1,1,3-trifluoropropane |
| $CH_2{=}CHOC(CFH_2)_2H$ | 2-ethenoxy-1,3-difluoropropane |

-continued

| FORMULA | NAME |
|---|---|
| $CH_3CH{=}CHOC(CF_3)_2H$ | 2-(1-propenoxy)-1,1,1,3,3,3-hexafluoropropane |
| $CH_3CH{=}CHOC(CF_3)(CF_2H)H$ | 2-(1-propenoxy)-1,1,1,3,3-pentafluoropropane |
| $CH_3CH{=}CHOC(CF_3)(CFH_2)H$ | 2-(1-propenoxy)-1,1,1,3-tetrafluoropropane |
| $CH_3CH{=}CHOC(CF_2H)_2H$ | 2-(1-propenoxy)-1,1,3,3-tetrafluoropropane |
| $CH_3CH{=}CHOC(CF_2H)(CFH_2)H$ | 2-(1-propenoxy)-1,1,3-trifluoropropane |
| $CH_3CH{=}CHOC(CFH_2)_2H$ | 2-(1-propenoxy)-1,3-difluoropropane |
| $CH_2{=}CHCH_2OC(CF_3)_2H$ | 2-(2-propenoxy)-1,1,1,3,3,3-hexafluoropropane |
| $CH_2{=}CHCH_2OC(CF_3)(CF_2H)H$ | 2-(2-propenoxy)-1,1,1,3,3-pentafluoropropane |
| $CH_2{=}CHCH_2OC(CF_3)(CFH_2)H$ | 2-(2-propenoxy)-1,1,1,3-tetrafluoropropane |
| $CH_2{=}CHCH_2OC(CF_2H)_2H$ | 2-(2-propenoxy)-1,1,3,3-tetrafluoropropane |
| $CH_2{=}CHCH_2OC(CF_2H)(CFH_2)H$ | 2-(2-propenoxy)-1,1,3-trifluoropropane |
| $CH_2{=}CHCH_2OC(CFH_2)_2H$ | 2-(2-propenoxy)-1,3-difluoropropane |
| $CH_2{=}CHOC(CF_3)(CF_2CF_3)H$ | 2-ethenoxy-1,1,1,3,3,4,4,4-octafluorobutane |
| $CH_2{=}CHOC(CF_3)(CF_2CF_2H)H$ | 2-ethenoxy-1,1,1,3,3,4,4-heptafluorobutane |
| $CH_2{=}CHOC(CF_3)(CFHCF_3)H$ | 2-ethenoxy-1,1,1,3,4,4,4-heptafluorobutane |
| $CH_2{=}CHOC(CF_3)(CF_2CFH_2)H$ | 2-ethenoxy-1,1,1,3,3,4-hexafluorobutane |
| $CH_2{=}CHOC(CF_3)(CFHCF_2H)H$ | 2-ethenoxy-1,1,1,3,4,4-hexafluorobutane |
| $CH_2{=}CHOC(CF_3)(CH_2CF_3)H$ | 2-ethenoxy-1,1,1,4,4,4-hexafluorobutane |
| $CH_2{=}CHOC(CF_3)(CF_2CH_3)H$ | 2-ethenoxy-1,1,1,3,3-pentafluorobutane |
| $CH_2{=}CHOC(CF_3)(CFHCFH_2)H$ | 2-ethenoxy-1,1,1,3,4-pentafluorobutane |
| $CH_2{=}CHOC(CF_3)(CH_2CF_2H)H$ | 2-ethenoxy-1,1,1,4,4-pentafluorobutane |
| $CH_2{=}CHOC(CF_3)(CH_2CFH_2)H$ | 2-ethenoxy-1,1,1,4-tetrafluorobutane |
| $CH_2{=}CHOC(CF_3)(CFHCH_3)H$ | 2-ethenoxy-1,1,1,3-tetrafluorobutane |
| $CH_2{=}CHOC(CF_2H)(CF_2CF_3)H$ | 2-ethenoxy-1,1,3,3,4,4,4-heptafluorobutane |
| $CH_2{=}CHOC(CF_2H)(CF_2CF_2H)H$ | 2-ethenoxy-1,1,3,3,4,4-hexafluorobutane |
| $CH_2{=}CHOC(CF_2H)(CFHCF_3)H$ | 2-ethenoxy-1,1,3,4,4,4-hexafluorobutane |
| $CH_2{=}CHOC(CF_2H)(CF_2CFH_2)H$ | 2-ethenoxy-1,1,3,3,4-pentafluorobutane |
| $CH_2{=}CHOC(CF_2H)(CFHCF_2H)H$ | 2-ethenoxy-1,1,3,4,4-pentafluorobutane |
| $CH_2{=}CHOC(CF_2H)(CH_2CF_3)H$ | 2-ethenoxy-1,1,4,4,4-pentafluorobutane |
| $CH_2{=}CHOC(CF_2H)(CH_2CH_3)H$ | 2-ethenoxy-1,1,3,3-tetrafluorobutane |
| $CH_2{=}CHOC(CF_2H)(CFHCFH_2)H$ | 2-ethenoxy-1,1,3,4-tetrafluorobutane |
| $CH_2{=}CHOC(CF_2H)(CH_2CF_2H)H$ | 2-ethenoxy-1,1,4,4-tetrafluorobutane |
| $CH_2{=}CHOC(CF_2H)(CH_2CFH_2)H$ | 2-ethenoxy-1,1,4-trifluorobutane |
| $CH_2{=}CHOC(CF_2H)(CFHCH_3)H$ | 2-ethenoxy-1,1,3-trifluorobutane |
| $CH_2{=}CHOC(CFH_2)(CF_2CF_3)H$ | 2-ethenoxy-1,3,3,4,4,4-hexafluorobutane |
| $CH_2{=}CHOC(CFH_2)(CF_2CF_2H)H$ | 2-ethenoxy-1,3,3,4,4-pentafluorobutane |
| $CH_2{=}CHOC(CFH_2)(CFHCF_3)H$ | 2-ethenoxy-1,3,4,4,4-pentafluorobutane |
| $CH_2{=}CHOC(CFH_2)(CF_2CFH_2)H$ | 2-ethenoxy-1,3,3,4-tetrafluorobutane |

-continued

| FORMULA | NAME |
|---|---|
| $CH_2{=}CHOC(CFH_2)(CFHCF_2H)H$ | 2-ethenoxy-1,3,4,4-tetrafluorobutane |
| $CH_2{=}CHOC(CFH_2)(CH_2CF_3)H$ | 2-ethenoxy-1,4,4,4-tetrafluorobutane |
| $CH_2{=}CHOC(CFH_2)(CF_2CH_3)H$ | 2-ethenoxy-1,3,3-trifluorobutane |
| $CH_2{=}CHOC(CFH_2)(CFHCFH_2)H$ | 2-ethenoxy-1,3,4-trifluorobutane |
| $CH_2{=}CHOC(CFH_2)(CH_2CF_2H)H$ | 2-ethenoxy-1,4,4-trifluorobutane |
| $CH_2{=}CHOC(CFH_2)(CH_2CFH_2)H$ | 2-ethenoxy-1,4-difluorobutane |
| $CH_2{=}CHOC(CFH_2)(CFHCH_3)H$ | 2-ethenoxy-1,3-difluorobutane |
| $CH_2{=}CHOC(CF_2CF_3)_2H$ | 3-ethenoxy-1,1,1,2,2,4,4,5,5,5-decafluoropentane |
| $CH_2{=}CHOC(CF_2CF_3)(CF_2CF_2H)H$ | 3-ethenoxy-1,1,1,2,2,4,4,5,5-nonafluoropentane |
| $CH_2{=}CHOC(CF_2CF_3)(CFHCF_3)H$ | 3-ethenoxy-1,1,1,2,2,4,5,5,5-nonafluoropentane |
| $CH_2{=}CHOC(CF_2CF_3)(CF_2CFH_2)H$ | 3-ethenoxy-1,1,1,2,2,4,4,5-octafluoropentane |
| $CH_2{=}CHOC(CF_2CF_3)(CFHCF_2H)H$ | 3-ethenoxy-1,1,1,2,2,4,5,5-octafluoropentane |
| $CH_2{=}CHOC(CF_2CF_3)(CH_2CF_3)H$ | 3-ethenoxy-1,1,1,2,2,5,5,5-octafluoropentane |
| $CH_2{=}CHOC(CF_2CF_3)(CF_2CH_3)H$ | 3-ethenoxy-1,1,1,2,2,4,4-heptafluoropentane |
| $CH_2{=}CHOC(CF_2CF_3)(CFHCFH_2)H$ | 3-ethenoxy-1,1,1,2,2,4,5-heptafluoropentane |
| $CH_2{=}CHOC(CF_2CF_3)(CH_2CF_2H)H$ | 3-ethenoxy-1,1,1,2,2,5,5-heptafluoropentane |
| $CH_2{=}CHOC(CF_2CF_3)(CH_2CFH_2)H$ | 3-ethenoxy-1,1,1,2,2,5-hexafluoropentane |
| $CH_2{=}CHOC(CF_2CF_3)(CFHCH_3)H$ | 3-ethenoxy-1,1,1,2,2,4-hexafluoropentane |
| $CH_2{=}CHOC(CF_2CF_2H)_2H$ | 3-ethenoxy-1,1,2,2,4,4,5,5-octafluoropentane |
| $CH_2{=}CHOC(CF_2CF_2H)(CFHCF_3)H$ | 3-ethenoxy-1,1,2,2,4,5,5,5-octafluoropentane |
| $CH_2{=}CHOC(CF_2CF_2H)(CF_2CFH_2)H$ | 3-ethenoxy-1,1,2,2,4,4,5-heptafluoropentane |
| $CH_2{=}CHOC(CF_2CF_2H)(CFHCF_2H)H$ | 3-ethenoxy-1,1,2,2,4,5,5-heptafluoropentane |
| $CH_2{=}CHOC(CF_2CF_2H)(CH_2CF_3)H$ | 3-ethenoxy-1,1,2,2,5,5,5-heptafluoropentane |
| $CH_2{=}CHOC(CF_2CF_2H)(CF_2CH_3)H$ | 3-ethenoxy-1,1,2,2,4,4-hexafluoropentane |
| $CH_2{=}CHOC(CF_2CF_2H)(CFHCFH_2)H$ | 3-ethenoxy-1,1,2,2,4,5-hexafluoropentane |
| $CH_2{=}CHOC(CF_2CF_2H)(CH_2CF_2H)H$ | 3-ethenoxy-1,1,2,2,5,5-hexafluoropentane |
| $CH_2{=}CHOC(CF_2CF_2H)(CH_2CFH_2)H$ | 3-ethenoxy-1,1,2,2,5-pentafluoropentane |
| $CH_2{=}CHOC(CF_2CF_2H)(CFHCH_3)H$ | 3-ethenoxy-1,1,2,2,4-pentafluoropentane |
| $CH_2{=}CHOC(CFHCF_3)_2H$ | 3-ethenoxy-1,1,1,2,4,5,5,5-octafluoropentane |
| $CH_2{=}CHOC(CFHCF_3)(CF_2CFH_2)H$ | 3-ethenoxy-1,1,1,2,4,4,5-heptafluoropentane |
| $CH_2{=}CHOC(CFHCF_3)(CFHCF_2H)H$ | 3-ethenoxy-1,1,1,2,4,5,5-heptafluoropentane |
| $CH_2{=}CHOC(CFHCF_3)(CH_2CF_3)H$ | 3-ethenoxy-1,1,1,2,5,5,5-heptafluoropentane |
| $CH_2{=}CHOC(CFHCF_3)(CF_2CH_3)H$ | 3-ethenoxy-1,1,1,2,4,4-hexafluoropentane |
| $CH_2{=}CHOC(CFHCF_3)(CFHCFH_2)H$ | 3-ethenoxy-1,1,1,2,4,5-hexafluoropentane |
| $CH_2{=}CHOC(CFHCF_3)(CH_2CF_2H)H$ | 3-ethenoxy-1,1,1,2,5,5-hexafluoropentane |
| $CH_2{=}CHOC(CFHCF_3)(CH_2CFH_2)H$ | 3-ethenoxy-1,1,1,2,5-pentafluoropentane |

-continued

| FORMULA | NAME |
|---|---|
| $CH_2{=}CHOC(CFHCF_3)(CFHCH_3)H$ | 3-ethenoxy-1,1,1,2,4-pentafluoropentane |
| $CH_2{=}CHOC(CF_2CFH_2)_2H$ | 3-ethenoxy-1,2,2,4,4,5-hexafluoropentane |
| $CH_2{=}CHOC(CF_2CFH_2)(CFHCF_2H)H$ | 3-ethenoxy-1,2,2,4,5,5-hexafluoropentane |
| $CH_2{=}CHOC(CF_2CFH_2)(CH_2CF_3)H$ | 3-ethenoxy-1,2,2,5,5,5-hexafluoropentane |
| $CH_2{=}CHOC(CF_2CFH_2)(CF_2CH_3)H$ | 3-ethenoxy-1,2,2,4,4-pentafluoropentane |
| $CH_2{=}CHOC(CF_2CFH_2)(CFHCFH_2)H$ | 3-ethenoxy-1,2,2,4,5-pentafluoropentane |
| $CH_2{=}CHOC(CF_2CFH_2)(CH_2CF_2H)H$ | 3-ethenoxy-1,2,2,5,5-pentafluoropentane |
| $CH_2{=}CHOC(CF_2CFH_2)(CH_2CFH_2)H$ | 3-ethenoxy-1,2,2,5-tetrafluoropentane |
| $CH_2{=}CHOC(CF_2CFH_2)(CFHCH_3)H$ | 3-ethenoxy-1,2,2,4-tetrafluoropentane |
| $CH_2{=}CHOC(CFHCF_2H)_2H$ | 3-ethenoxy-1,1,2,4,5,5-hexafluoropentane |
| $CH_2{=}CHOC(CFHCF_2H)(CH_2CF_3)H$ | 3-ethenoxy-1,1,2,5,5,5-hexafluoropentane |
| $CH_2{=}CHOC(CFHCF_2H)(CF_2CH_3)H$ | 3-ethenoxy-1,1,2,4,4-pentafluoropentane |
| $CH_2{=}CHOC(CFHCF_2H)(CFHCFH_2)H$ | 3-ethenoxy-1,1,2,4,5-pentafluoropentane |
| $CH_2{=}CHOC(CFHCF_2H)(CH_2CF_2H)H$ | 3-ethenoxy-1,1,2,5,5-pentafluoropentane |
| $CH_2{=}CHOC(CFHCF_2H)(CH_2CFH_2)H$ | 3-ethenoxy-1,1,2,5-tetrafluoropentane |
| $CH_2{=}CHOC(CFHCF_2H)(CFHCH_3)H$ | 3-ethenoxy-1,1,2,4-tetrafluoropentane |
| $CH_2{=}CHOC(CH_2CF_3)_2H$ | 3-ethenoxy-1,1,1,5,5,5-hexafluoropentane |
| $CH_2{=}CHOC(CH_2CF_3)(CF_2CH_3)H$ | 3-ethenoxy-1,1,1,4,4-pentafluoropentane |
| $CH_2{=}CHOC(CH_2CF_3)(CFHCFH_2)H$ | 3-ethenoxy-1,1,1,4,5-pentafluoropentane |
| $CH_2{=}CHOC(CH_2CF_3)(CH_2CF_2H)H$ | 3-ethenoxy-1,1,1,5,5-pentafluoropentane |
| $CH_2{=}CHOC(CH_2CF_3)(CH_2CFH_2)H$ | 3-ethenoxy-1,1,1,5-tetrafluoropentane |
| $CH_2{=}CHOC(CH_2CF_3)(CFHCH_3)H$ | 3-ethenoxy-1,1,1,4-tetrafluoropentane |
| $CH_2{=}CHOC(CF_2CH_3)_2H$ | 3-ethenoxy-2,2,4,4-tetrafluoropentane |
| $CH_2{=}CHOC(CF_2CH_3)(CFHCFH_2)H$ | 3-ethenoxy-2,2,4,5-tetrafluoropentane |
| $CH_2{=}CHOC(CF_2CH_3)(CH_2CF_2H)H$ | 3-ethenoxy-2,2,5,5-tetrafluoropentane |
| $CH_2{=}CHOC(CF_2CH_3)(CH_2CFH_2)H$ | 3-ethenoxy-2,2,5-trifluoropentane |
| $CH_2{=}CHOC(CF_2CH_3)(CFHCH_3)H$ | 3-ethenoxy-2,2,4-trifluoropentane |
| $CH_2{=}CHOC(CFHCFH_2)_2H$ | 3-ethenoxy-1,2,4,5-tetrafluoropentane |
| $CH_2{=}CHOC(CFHCFH_2)(CH_2CF_2H)H$ | 3-ethenoxy-1,2,5,5-tetrafluoropentane |
| $CH_2{=}CHOC(CFHCFH_2)(CH_2CFH_2)H$ | 3-ethenoxy-1,2,5-trifluoropentane |
| $CH_2{=}CHOC(CFHCFH_2)(CFHCH_3)H$ | 3-ethenoxy-1,2,4-trifluoropentane |
| $CH_2{=}CHOC(CH_2CF_2H)_2H$ | 3-ethenoxy-1,1,5,5-tetrafluoropentane |
| $CH_2{=}CHOC(CH_2CF_2H)(CH_2CFH_2)H$ | 3-ethenoxy-1,1,5-trifluoropentane |
| $CH_2{=}CHOC(CH_2CF_2H)(CFHCH_3)H$ | 3-ethenoxy-1,1,4-trifluoropentane |
| $CH_2{=}CHOC(CH_2CFH_2)_2H$ | 3-ethenoxy-1,5-difluoropentane |
| $CH_2{=}CHOC(CH_2CFH_2)(CFHCH_3)H$ | 3-ethenoxy-1,4-difluoropentane |
| $CH_2{=}CHOC(CFHCH_3)_2H$ | 3-ethenoxy-2,4-difluoropentane |

The preferred solvents of the Formula above are where R has 1 or 2 carbon atoms and A and B each have 1 carbon atom. The more preferred solvents are $CH_3OC(CF_3)_2H$; $CH_3CH_2OC(CF_3)_2H$; $CH_3OC(CF_2H)_2H$; and $CH_3OC(CF_3)(CF_2H)H$. The most preferred solvents are $CH_3(CF_3)_2H$ and $CH_3CH_2OC(CF_3(_2H$.

The solvents of the present invention may be prepared by adapting known methods for preparing known partially or perfluorinated ethers such as taught by U.S. Pat. No. 4,943,595 or Richard D. Chambers et al., "Free-Radical Chemistry, Part 8—Electrochemical Fluorination of Partly Fluorinated Ethers", *J. of Fluorine Chem.* 49, 409 (1990) coupled with the knowledge of one skilled in the art.

It may be desirable to use a blend of two or more of the present partially fluorinated ethers having a tertiary structure. It may also be desirable to use a blend of one of the present partially fluorinated ethers having a tertiary structure with a known solvent.

The present method substantially dissolves or removes most contaminants from the surface of a substrate. For example, the present method dissolves or removes organic contaminants such as mineral oils from the surface of a substrate. Under the term "mineral oils", both petroleum-based and petroleum-derived oils are included. Lubricants such as engine oil, machine oil, and cutting oil are examples of petroleum-derived oils. The present method also dissolves or removes synthetic, semi-synthetic, and water emusifiable oils. The present method is particularly useful in dissolving or removing perfluorinated contaminants.

The present method also substantially dissolves or removes inorganic contaminants such as water from the surface of a substrate. The method may be used in the single-stage or multi-stage drying of objects.

The present method may be used to clean the surface of inorganic and organic substrates. Examples of inorganic substrates include metallic substrates, ceramic substrates, and glass substrates. Examples of organic substrates include polymeric substrates such as polycarbonate, polystyrene, and acrylonitrile-butadiene-styrene. The method also may be used to clean the surface of natural fabrics such as cotton, silk, fur, suede, leather, linen, and wool. The method also may be used to clean the surface of synthetic fabrics such as polyester, rayon, acrylics, nylon, and blends thereof, and blends of synthetic and natural fabrics. It should also be understood that composites of the foregoing materials may be cleaned by the present method. The present method may be particularly useful in cleaning the surface of polycarbonate, polystyrene, and acrylonitrile-butadiene-styrene substrates.

The present method may be used in vapor degreasing, solvent cleaning, cold cleaning, dewatering, dry cleaning, defluxing, decontamination, spot cleaning, aerosol propelled rework, extraction, particle removal, and surfactant cleaning applications. In these uses, the object to be cleaned is immersed in one or more stages in the liquid and/or vaporized solvent or is sprayed with the liquid solvent. Elevated temperatures, ultrasonic energy, and/or agitation may be used to intensify the cleaning effect.

In one embodiment of the present invention, the solvents are sprayed onto the substrates by using a propellant. Preferably, the propellant is selected from the group consisting of hydrochlorofluorocarbon, hydrofluorocarbon, and mixtures thereof. Useful hydrochlorofluorocarbon propellants include dichlorofluoromethane (known in the art as HCFC-21), chlorodifluoromethane (known in the art as HCFC-22), 1,1-dichloro-2,2-difluoroethane (known in the art as HCFC-132a), 1-chloro-2,2,2-trifluoroethane (known in the art as HCFC-133), and 1-chloro-1,1-difluoroethane (known in the art as HCFC-142b); commercially available HCFC-21, HCFC-22, and HCFC-142b may be used in the present invention. Useful hydrofluorocarbon propellants include trifluoromethane (known in the art as HFC-23), 1,1,1,2-tetrafluoroethane (known in the art as HFC-134a), and 1,1-difluoroethane (known in the art as HFC-152a); commercially available HFC-23 and HFC-152a may be used in the present invention. Until HFC-134a becomes available in commercial quantities, HFC-134a may be made by a known method such as that disclosed by U.S. Pat. No. 4,851,595. Preferred propellants include chlorodifluoromethane and 1,1,1,2-tetrafluoroethane.

The present invention is more fully illustrated by the following non-limiting Examples.

EXAMPLES 1 THROUGH 339

Each solvent listed in the Table above is added to mineral oil in a weight ratio of 50:50 at 270° C. Each solvent is miscible in the mineral oil.

EXAMPLES 340 THROUGH 678

Metal coupons are soiled with various types of oil. The soiled metal coupons are immersed in the solvents of the Table above for a period of 15 seconds to 2 minutes, removed, and allowed to air dry upon visual inspection, the soil appears to be substantially removed.

EXAMPLES 679 THROUGH 1,017

Metal coupons are soiled with various types of oil. The soiled metal coupons are sprayed with the solvents of the Table above and allowed to air dry. Upon visual inspection, the soil appears to be substantially removed.

Having described the invention in detail and by reference to preferred embodiments thereof, it will be apparent that modifications and variations are possible without departing from the scope of the invention defined in the appended claims.

What is claimed is:

1. A method of substantially dissolving contaminants or removing contaminants from the surface of a substrate which comprises the step of:

using a solvent of the Formula

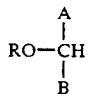

wherein R is a hydrocarbon having 1 to 3 carbon atoms and A and B are the same or different and partially fluorinated or perfluorinated alkyl groups having 1 to 2 carbon atoms.

2. The method of claim 1 wherein said method dissolves or removes inorganic contaminants from said surface of said substrate.

3. The method of claim 1 wherein said method removes water from said surface of said substrate.

4. The method of claim 1 wherein said method dissolves or removes organic contaminants from said surface of said substrate.

5. The method of claim 1 wherein said method removes contaminants from the surface of an inorganic substrate.

6. The method of claim 1 wherein said method removes contaminants from the surface of an organic substrate.

7. The method of claim 1 wherein said solvent is selected from the group consisting of $CH_2{=}CHOC(CF_3)_2H$; $CH_2{=}CHOC(CF_3)(CF_2H)H$; $CH_2{=}CHOC(CF_3)(CFH_2)H$; $CH_2{=}CHOC(CF_2H)_2H$; $CH_2{=}CHOC(CF_2H)(CFH_2)H$; and $CH_2{=}CHOC(CFH_2)_2H$.

8. The method of claim 1 wherein said solvent is selected from the group consisting of $CH_3CH{=}CHOC(CF_3)_2H$; $CH_3CH{=}CHOC(CF_3)(CF_2H)H$; $CH_3CH{=}CHOC(CF_3)(CFH_2)H$; $CH_3CH{=}CHOC(CF_2H)_2H$;$CH_3CH{=}CHOC(CF_2H)(CFH_2)H$; and $CH_3CH{=}CHOC(CFH_2)_2H$.

9. The method of claim 1 wherein said solvent is selected from the group consisting of $CH_2{=}CHCH_2OC(CF_3)_2H$;$CH_2{=}CHCH_2OC(CF_3)(CF_2H)H$; $CH_2{=}CHCH_2OC(CF_3)(CFH_2)H$; $CH_2{=}CHCH_2OC(CF_2H)_2H$; $CH_2{=}CHCH_2OC(CF_2H)(CFH_2)H$; and $CH_2{=}CHCH_2OC(CFH_2)_2H$.

10. The method of claim 1 wherein said solvent is selected from the group consisting of $CH_3(CH_2)_2OC(CF_3)_2H$; $CH_3(CH_2)_2OC(CF_3)(CF_2H)H$; $CH_3(CH_2)_2OC(CF_3)(CFH_2)H$; $CH_3(CH_2)_2OC(CF_2H)_2H$;$CH_3(CH_2)_2OC(CF_2H)(CFH_2)H$; and $CH_3(CH_2)_2OC(CFH_2)_2H$.

11. The method of claim 1 wherein said solvent is selected from the group consisting of (CH3)2CHOC(CF3)2H; $(CH_3)_2CHOC(CF_3)(CF_2H)H$;$(CH_3)_2CHOC(CF_3)(CFH_2)H$; $(CH_3)_2CHOC(CF_2H)_2H$;$(CH_3)_2CHOC(CF_2H)(CFH_2)H$; and $(CH_3)_2CHOC(CFH_2)_2H$.

12. The method of claim 1 wherein said R has 1 or 2 carbon atoms.

13. The method of claim 1 wherein said solvent is selected from the group consisting of $CH_3OC(CF_3)_2H$; $CH_3OC(CF_3)(CF_2H)H$;$CH_3OC(CF_3)(CFH_2)H$; $CH_3OC(CF_2H)_2H$; $CH_3OC(CF_2H)(CFH_2)H$; and $CH_3OC(CFH_2)_2H$.

14. The method of claim 1 wherein said solvent is selected from the group consisting of $CH_3CH_2OC(CF_3)_2H$; $CH_3CH_2OC(CF_3)(CF_2H)H$;$CH_3CH_2OC(CF_3)(CFH_2)H$; $CH_3CH_2OC(CF_2H)_2H$;$CH_3CH_2OC(CF_2H)(CFH_2)H$; and $CH_3CH_2OC(CFH_2)_2H$.

15. The method of claim 1 wherein said solvent is $CH_3OC(CF_2H)_2H$.

16. The method of claim 1 wherein said solvent is $CH_3OC(CF_3)(CF_2H)H$.

17. The method of claim 1 wherein said solvent is $CH_3OC(CF_3)_2H$.

18. The method of claim 1 wherein said solvent is $CH_3CH_2OC(CF_3)_2H$.

* * * * *